US008128349B2

(12) United States Patent
Lutjen et al.

(10) Patent No.: US 8,128,349 B2
(45) Date of Patent: Mar. 6, 2012

(54) GAS TURBINE ENGINES AND RELATED SYSTEMS INVOLVING BLADE OUTER AIR SEALS

(75) Inventors: Paul M. Lutjen, Kennebunkport, ME (US); Susan M. Tholen, Kennebunk, CT (US)

(73) Assignee: United Technologies Corp., Hartford, CT (US)

( * ) Notice: Subject to any disclaimer, the term of this patent is extended or adjusted under 35 U.S.C. 154(b) by 1384 days.

(21) Appl. No.: 11/873,659

(22) Filed: Oct. 17, 2007

(65) Prior Publication Data

US 2009/0104025 A1 Apr. 23, 2009

(51) Int. Cl.
*F01D 11/08* (2006.01)

(52) U.S. Cl. ..... 415/173.1

(58) Field of Classification Search ..... 415/173.1, 415/200, 139

See application file for complete search history.

(56) References Cited

U.S. PATENT DOCUMENTS

| | | | | |
|---|---|---|---|---|
| 4,466,772 | A | 8/1984 | Okapuu et al. | |
| 4,861,618 | A | 8/1989 | Vine et al. | |
| 5,705,231 | A | 1/1998 | Nissley et al. | |
| 5,780,171 | A | 7/1998 | Nissley et al. | |
| 6,261,053 | B1 * | 7/2001 | Anderson et al. | 415/115 |
| 6,340,286 | B1 | 1/2002 | Aksit et al. | |
| 6,358,002 | B1 | 3/2002 | Good et al. | |
| 6,464,453 | B2 | 10/2002 | Toborg et al. | |
| 6,533,542 | B2 * | 3/2003 | Sugishita et al. | 415/139 |
| 6,547,522 | B2 | 4/2003 | Turnquist et al. | |
| 6,899,339 | B2 | 5/2005 | Sanders et al. | |
| 7,001,145 | B2 | 2/2006 | Couture et al. | |
| 7,033,138 | B2 * | 4/2006 | Tomita et al. | 415/139 |
| 7,670,108 | B2 * | 3/2010 | Liang | 415/173.1 |

* cited by examiner

*Primary Examiner* — Ninh H Nguyen

(57) ABSTRACT

Gas turbine engines and related systems involving blade outer air seals are provided. In this regard, a representative blade outer air seal assembly for a gas turbine engine includes: an annular arrangement of outer air seal segments defining an inner diameter surface; intersegment gaps located between the outer air seal segments, each of the gaps being located between a corresponding adjacent pair of the segments; and recesses spaced about the inner diameter surface, each of the recesses communicating with a corresponding one of the gaps.

16 Claims, 3 Drawing Sheets

GAS TURBINE ENGINES AND RELATED SYSTEMS INVOLVING BLADE OUTER AIR SEALS

STATEMENT REGARDING FEDERALLY SPONSORED RESEARCH AND DEVELOPMENT

The U.S. Government may have an interest in the subject matter of this disclosure as provided for by the terms of contract number N00019-02-C-3003, awarded by the United States Navy, and contract number F33615-03-D-2345 DO-0009, awarded by the United States Air Force.

BACKGROUND

1. Technical Field

The disclosure generally relates to gas turbine engines.

2. Description of the Related Art

A typical gas turbine engine incorporates a compressor section and a turbine section, each of which includes rotatable blades and stationary vanes. Within a surrounding engine casing, the radial outermost tips of the blades are positioned in close proximity to outer air seals. Outer air seals are parts of shroud assemblies mounted within the engine casing. Each outer air seal typically incorporates multiple segments that are annularly arranged within the engine casing, with the inner diameter surfaces of the segments being located closest to the blade tips.

SUMMARY

Gas turbine engines and related systems involving blade outer air seals are provided. In this regard, an exemplary embodiment of a blade outer air seal assembly for a gas turbine engine comprises: an annular arrangement of outer air seal segments defining an inner diameter surface; intersegment gaps located between the outer air seal segments, each of the gaps being located between a corresponding adjacent pair of the segments; and recesses spaced about the inner diameter surface, each of the recesses communicating with a corresponding one of the gaps.

An exemplary embodiment of a gas turbine engine comprises: a compressor; a combustion section; a turbine operative to drive the compressor responsive to energy imparted thereto by the combustion section, the turbine having a rotatable set of blades; and a blade outer air seal assembly positioned radially outboard of the blades, the outer air seal assembly having an annular arrangement of outer air seal segments, intersegment gaps and recesses, the outer air seal segments defining an inner diameter surface, the intersegment gaps being located between the outer air seal segments, each of the gaps being located between a corresponding adjacent pair of the segments, the recesses being spaced about the inner diameter surface, and each of the recesses communicating with a corresponding one of the gaps.

An exemplary embodiment of a blade outer air seal segment comprises: a blade arrival end; a blade departure end; and an inner diameter surface extending at least partially between the blade arrival end and the blade departure end, at least a portion of the inner diameter surface being arcuately shaped as defined by a radius of curvature, a radially innermost portion of the inner diameter surface in a vicinity of the blade arrival end being located outboard of the radius of curvature.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Gas turbine engines and related systems involving blade outer air seals are provided, several exemplary embodiments of which will be described in detail. In some embodiments, outer air seal segments incorporate blade arrival portions that include surfaces located radially outboard of corresponding surfaces of blade departure portions of adjacent segments. Thus, a spaced arrangement of recesses is provided about the inner diameter surface defined by the segments. Configuring the surfaces of the blade arrival portions in such a manner may tend to reduce wear of those surfaces.

Figure 1:
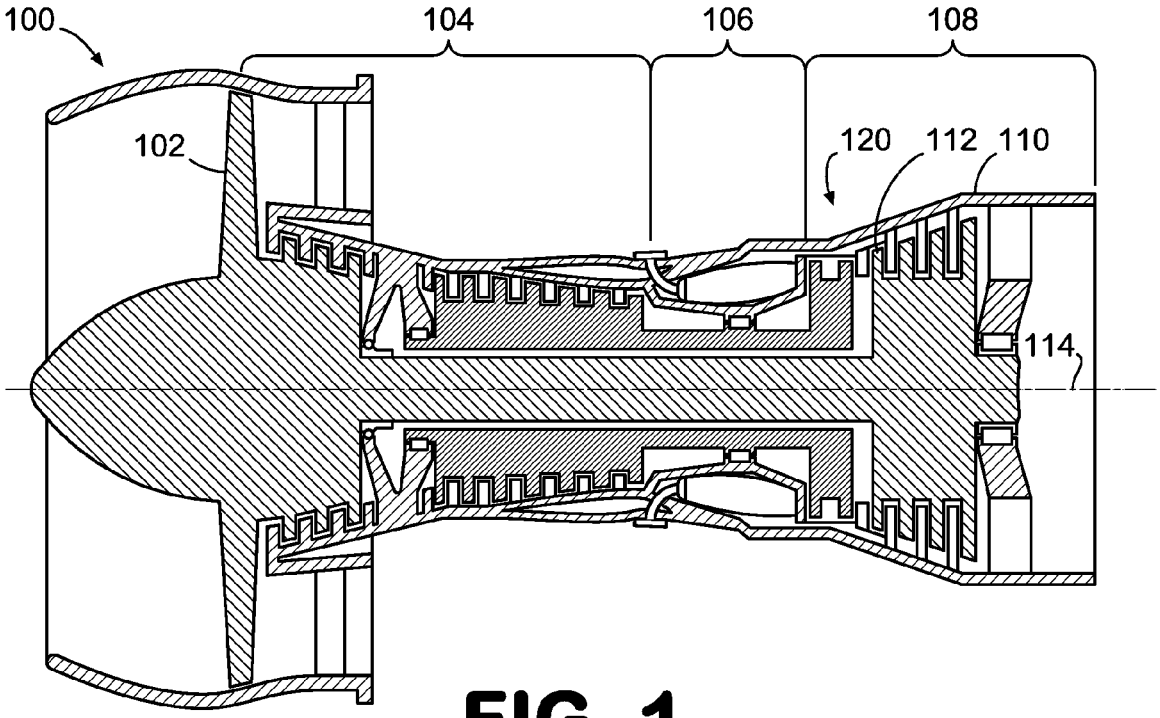
FIG. 1 is a schematic diagram depicting an exemplary embodiment of a gas turbine engine.

Referring now in more detail to the drawings, FIG. 1 is a schematic diagram depicting an exemplary embodiment of a gas turbine engine. As shown in FIG. 1, engine 100 incorporates a fan 102, a compressor section 104, a combustion section 106 and a turbine section 108. Various components of the engine are housed within an engine casing 110, such as a blade 112 of the low-pressure turbine, that extends along a longitudinal axis 114. Although engine 100 is configured as a turbofan engine, there is no intention to limit the concepts described herein to use with turbofan engines as various other configurations of gas turbine engines can be used.

Figure 2:
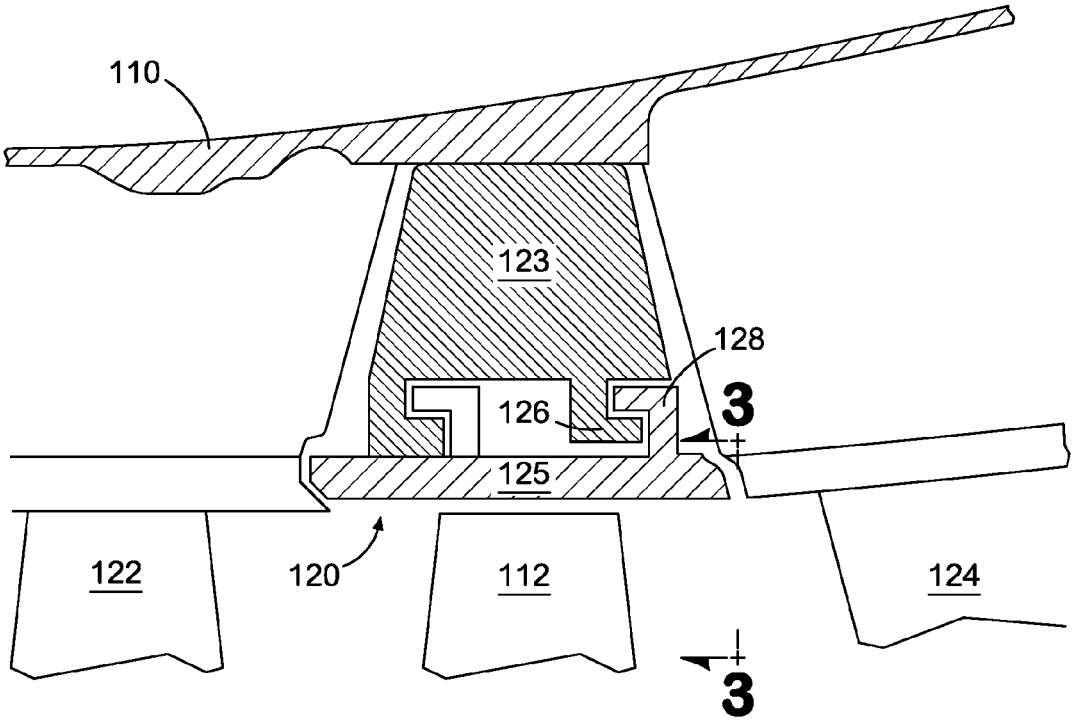
FIG. 2 is a partially cut-away, schematic diagram depicting a portion of the embodiment of FIG. 1.

A portion of engine 100 is depicted in greater detail in the schematic diagram of FIG. 2. In particular, FIG. 2 depicts a portion of blade 112 and a corresponding portion of a shroud assembly 120 that are located within engine casing 110. Notably, blade 112 is positioned between vanes 122 and 124, detail of which has been omitted from FIG. 2 for ease of illustration and description.

As shown in FIG. 2, shroud assembly 120 is positioned between the rotating blades and the casing. The shroud assembly generally includes an annular mounting ring 123 and an annular outer air seal 125 attached to the mounting ring and positioned adjacent to the blades. Various other seals are provided both forward and aft of the shroud assembly. However, these various seals are not relevant to this discussion.

Attachment of the outer air seal to the mounting ring in the embodiment of FIG. 2 is facilitated by interlocking flanges. Specifically, the mounting ring includes flanges (e.g., flange 126) that engage corresponding flanges (e.g., flange 128) of the outer air seal. Other attachment techniques may be used in other embodiments.

Figure 3:
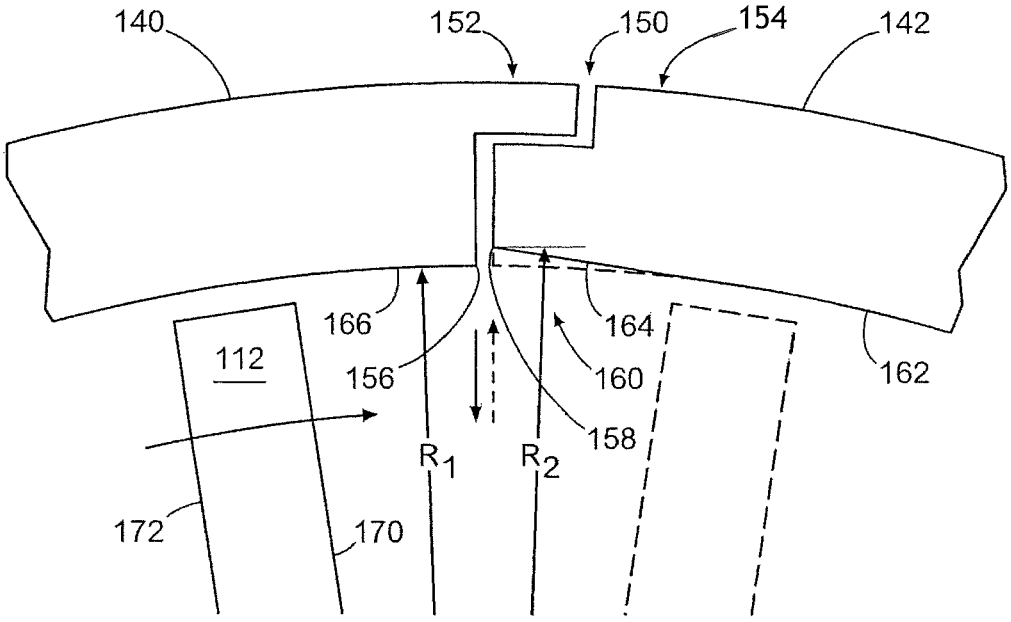
FIG. 3 is a partially cut-away, schematic diagram depicting a portion of the shroud assembly of the embodiment of FIGS. 1 and 2.

With respect to the annular configuration of the outer air seal, outer air seal 125 is formed of multiple arcuate segments, portions of two of which are depicted schematically in FIG. 3. As shown in FIG. 3, adjacent segments 140, 142 of the outer air seal are oriented in an end-to-end relationship, with an intersegment gap 150 located between the segments.

Portions defining the intersegment gap include a blade departure end 152 of segment 140 and a blade arrival end 154 of segment 142. Generally, the ends interlock with each other with the intersegment gap varying in shape between embodiments.

A recess 160, which communicates with the gap, also is defined by at least a portion of one of the ends. In the embodiment of FIG. 3, the recess is defined by a surface of segment 142. Specifically, a portion 162 of an inner diameter surface of segment 142 is located at a distance $R_1$ from the longitudinal axis (114) of the engine and a portion 164 of the inner diameter surface is located at a greater distance from the longitudinal axis, i.e., located up to a distance $R_2$ from the longitudinal axis. Notably, portion 164 defines the recess, i.e., $R_2$ is longer than $R_1$. It should also be noted that portion 162 of the embodiment of FIG. 3 extends to the blade departure end of segment 142 (not shown) such that the inner diameter surface 166 of the blade departure end is located at distance $R_1$. Since segment 140 and 142 are duplicate components in this embodiment, the inner diameter surface of blade departure end 152 of segment 140 is located at distance $R_1$. Thus, the inner diameter surface in the vicinity of the blade arrival end is positioned radially outboard of the inner diameter surface in the vicinity of the blade departure end of the adjacent segment. Stated differently, a radially innermost portion of the blade arrival end is located radially outboard of a radially innermost portion of the blade departure end The aforementioned configuration may tend to reduce stresses and corresponding wear exhibited by the blade arrival end over time. Notably, the advancing suction side of each rotating blade (e.g., side 170 of blade 112) tends to promote a radial inboard-directed ingestion flow of hot gas (depicted by the solid arrow) from the intersegment gap. In contrast, the retreating pressure side of each rotating blade (e.g., side 172 of blade 112) tends to promote a radial outboard-directed ingestion flow of hot gas (depicted by the dashed arrow) into the intersegment gap. By ensuring that a portion of the blade arrival end of a segment is located radially outboard of a corresponding portion of the blade departure end of an adjacent segment, a pressure dam condition can be avoided that can result in pressure augmentation experienced by the inner diameter surface at the blade arrival end. Such pressure augmentation can result in increased hot gas ingestion into the intersegment gap, which can lead to component deterioration.

Additionally or alternatively, ensuring that a portion of the blade arrival end of a segment is located radially outboard of a corresponding portion of the blade departure end of an adjacent segment may prevent an augmented heat transfer coefficient and heat load at the blade arrival end. Notably, avoiding such an augmented heat transfer coefficient and heat load could retard segment erosion at the blade arrival end.

Locating an inner diameter surface of a blade arrival end outboard of a corresponding surface of a blade departure end can be accomplished in a variety of manners. By way of example, the embodiment of FIG. 3 uses a portion 164 of the inner diameter surface that is arcuately shaped. Specifically, portion 164 exhibits an outside radius curvature. In other embodiments, a different curvature (e.g., outside radius or compound curves) or no curvature (e.g., a planar surface) can be used.

Figure 4:
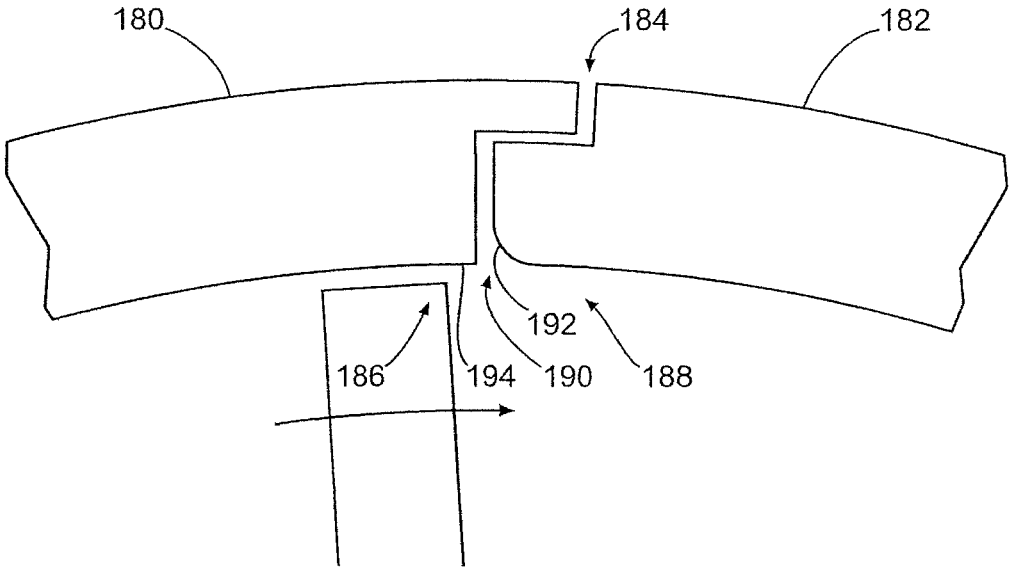
FIG. 4 is a partially cut-away, schematic diagram depicting a portion of another embodiment of a blade outer air seal.

In contrast, the embodiment of FIG. 4 involves an inner diameter surface that exhibits an inside radius curvature. In particular, segments 180, 182 are oriented in an end-to-end relationship, with an intersegment gap 184 located between the segments. Portions defining the intersegment gap include a blade departure end 186 of segment 180 and a blade arrival end 188 of segment 182.

A recess 190 communicates with gap 184 that is defined by portion 192 of the inner diameter surface of segment 182. As shown in FIG. 4, portion 192 exhibits an inside radius curvature. Notably, the corresponding portion 194 of segment 180 does not exhibit a curvature.

Figure 5:
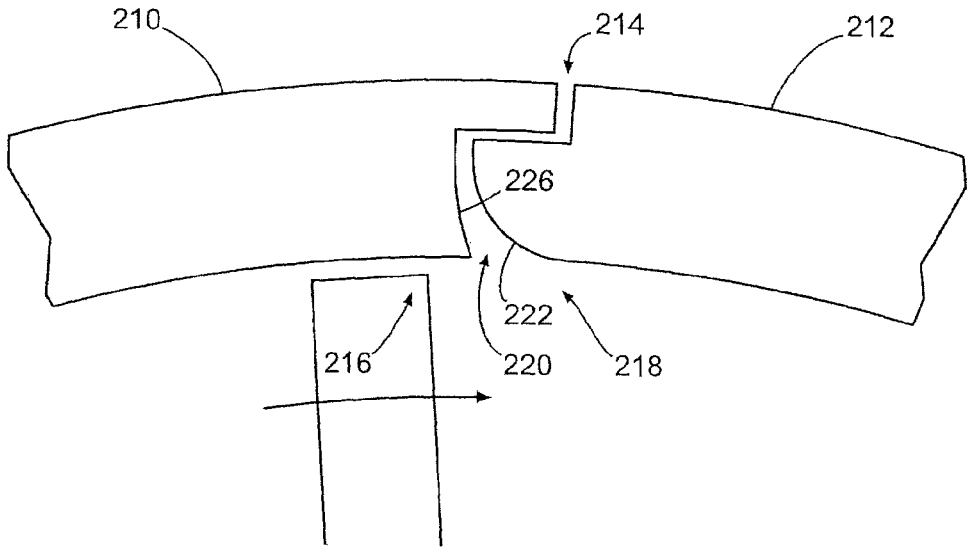
FIG. 5 is a partially cut-away, schematic diagram depicting a portion of another embodiment of a blade outer air seal.

Another embodiment is depicted schematically in FIG. 5. As shown in FIG. 5, adjacent segments 210, 212 are oriented in an end-to-end relationship, with an intersegment gap 214 located between the segments. Portions defining the intersegment gap include a blade departure end 216 of segment 210 and a blade arrival end 218 of segment 212.

A recess 220 communicates with gap 214 that is defined by portion 222 of the inner diameter surface of segment 212. As shown in FIG. 5, portion 222 exhibits an inside radius curvature, Notably, surface 226 of the blade departure end exhibits an outside radius curvature that complements the contour of portion 222 of segment 212.

Figure 6:
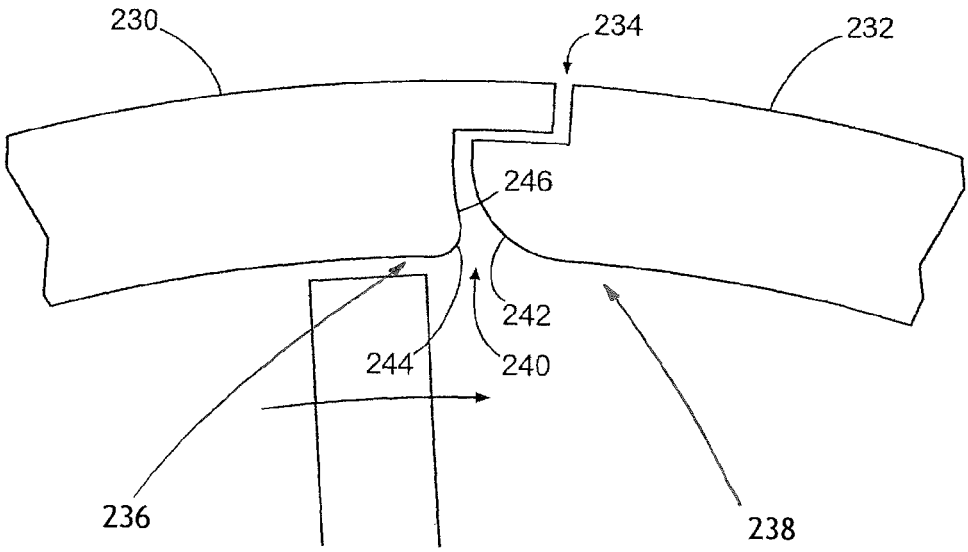
FIG. 6 is a partially cut-away, schematic diagram depicting a portion of another embodiment of a blade outer air seal.

Another embodiment is depicted schematically in FIG. 6. As shown in FIG. 6, adjacent segments 230, 232 are oriented in an end-to-end relationship, with an intersegment gap 234 located between the segments. Portions defining the intersegment gap include a blade departure end 236 of segment 230 and a blade arrival end 238 of segment 232.

A recess 240 communicates with gap 234 that is defined by portion 242 of the inner diameter surface of segment 232 and portion 244 of the inner diameter surface of segment 230. As shown in FIG. 6, portion 242 exhibits an inside radius curvature, and portion 244 of the inner diameter surface of segment 230 exhibits an inside radius curvature. Notably, however, surface 246 of the blade departure end exhibits an outside radius curvature that complements the contour of portion 242 of segment 232.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

The invention claimed is:

1. A blade outer air seal assembly for a gas turbine engine comprising:

an annular arrangement of outer air seal segments defining an inner diameter surface;

intersegment gaps located between the outer air seal segments, each of the gaps being located between a corresponding adjacent pair of the segments; and recesses spaced about the inner diameter surface, each of the recesses communicating with a corresponding one of the gaps;

wherein a first of the gaps is defined by a blade departure end of a first of the segments and a blade arrival end of a second of the segments;

wherein a radially innermost portion of the blade arrival end is located radially outboard of a radially innermost portion of the blade departure end;

wherein the blade arrival end exhibits an inside radius curvature; and wherein the blade departure end exhibits an outside radius curvature.

2. The assembly of claim 1, wherein:

the blade arrival end has a rounded edge; and the blade departure end has a rounded edge.

3. The assembly of claim 1, wherein:

the first of the segments has an inner diameter segment surface defining a portion of the inner diameter surface, the inner diameter segment surface terminating at an edge; and a first of the recesses is at least partially defined by a contour of the edge.

4. The assembly of claim 3, wherein the edge is a rounded edge.

5. The assembly of claim 1, wherein:

the second of the segments has an inner diameter segment surface defining a portion of the inner diameter surface, the inner diameter segment surface terminating at an edge; and a first of the recesses is at least partially defined by a contour of the edge.

6. The assembly of claim 5, wherein the edge is a rounded edge.

7. The engine gas turbine engine comprising;

a compressor;

a combustion section;

a turbine operative to drive the compressor responsive to energy imparted thereto by the combustion section, the turbine having a rotatable set of blades; and a blade outer air seal assembly positioned radially outboard of the blades, the outer air seal assembly having an annular arrangement of outer air seal segments, intersegment gaps and recesses, the outer air seal segments defining an inner diameter surface, the intersegment gaps being located between the outer air seal segments, each of the gaps being located between a corresponding adjacent air of the segments, the recesses being spaced about the inner diameter surface, and each of the recesses communicating with a corresponding one of the gaps;

wherein a first of the gaps is defined by a blade departure end of a first of the segments and a blade arrival end of a second of the segments;

wherein a radially innermost portion of the blade arrival end is located radially outboard of a radially innermost portion of the blade departure end;

wherein the blade arrival end exhibits an inside radius curvature; and wherein the blade departure end exhibits an outside radius curvature.

8. The engine of claim 7, wherein:

the first of the segments has an inner diameter segment surface defining a portion of the inner diameter surface, the inner diameter segment surface terminating at an edge; and a first of the recesses is at least partially defined by a contour of the edge.

9. The engine of claim 8, wherein the edge is a rounded edge.

10. The engine of claim 7, wherein:

the blade arrival end has a rounded edge; and the blade departure end has a rounded edge.

11. The engine of claim 7, wherein:

the second of the segments has an inner diameter segment surface defining a portion of the inner diameter surface, the inner diameter segment surface terminating at an edge; and a first of the recesses is at least partially defined by a contour of the edge.

12. The engine of claim 11, wherein the edge is a rounded edge.

13. A blade outer air seal segment comprising:

a blade arrival end;

a blade departure end; and an inner diameter surface extending at least partially between the blade arrival end and the blade departure end, at least a portion of the inner diameter surface being arcuately shaped as defined by a radius of curvature, a radially innermost portion of the inner diameter surface in a vicinity of the blade arrival end being located outboard of the radius of curvature;

wherein the blade arrival end exhibits an inside radius curvature; and wherein the blade departure end exhibits an outside radius curvature.

14. The segment of claim 13, wherein the radially innermost portion of the inner diameter surface in a vicinity of the blade arrival end is defined by a recess.

15. The segment of claim 14, wherein:

the inner diameter segment surface terminates at an edge; and the recess is at least partially defined by a contour of the edge.

16. The segment of claim 15, wherein the edge is a rounded edge.

* * * * *